US012808136B2

(12) United States Patent
Gui

(10) Patent No.: US 12,808,136 B2
(45) Date of Patent: Nov. 24, 2026

(54) CONTAINER FOR PICKING UP MATERIAL WITHOUT CONTACT

(71) Applicant: Vittorio Gui, Bologna (IT)

(72) Inventor: Vittorio Gui, Bologna (IT)

( * ) Notice: Subject to any disclaimer, the term of this patent is extended or adjusted under 35 U.S.C. 154(b) by 499 days.

(21) Appl. No.: 18/485,910

(22) Filed: Oct. 12, 2023

(65) Prior Publication Data

US 2024/0133139 A1 Apr. 25, 2024
US 2024/0229390 A9 Jul. 11, 2024

(30) Foreign Application Priority Data

Oct. 21, 2022 (IT) ..... 102022000021804

(51) Int. Cl.
*E01H 1/00* (2006.01)
*E01H 1/12* (2006.01)

(52) U.S. Cl.
CPC ..... *E01H 1/12* (2013.01)

(58) Field of Classification Search
CPC ..... A01K 29/00; A01K 23/00; E01H 1/12
USPC ..... 294/1.3
See application file for complete search history.

(56) References Cited

U.S. PATENT DOCUMENTS

2007/0296227 A1* 12/2007 Li ..... E01H 1/1206 294/1.3

FOREIGN PATENT DOCUMENTS

EP 2327837 A1 * 6/2011 ..... E01H 1/1206

* cited by examiner

*Primary Examiner* — Jacob A Smith
(74) *Attorney, Agent, or Firm* — Egbert, McDaniel & Swartz, PLLC

(57) ABSTRACT

Disclosed is a container including: a containment bag, and a narrowing element inside a closing passage of the containment bag for reducing an inlet section of the containment bag. The narrowing element has a bending stiffness around a direction of extension of the containment bag that is lower than a bending stiffness around an axis perpendicular to the direction of extension. The narrowing element has a first gripping zone and a second gripping zone. The narrowing element is configured so that the opening reduces the inlet section by pulling the first gripping zone in a first direction and pulling or pushing the second gripping zone in a second direction.

8 Claims, 4 Drawing Sheets

CONTAINER FOR PICKING UP MATERIAL WITHOUT CONTACT

FIELD OF THE INVENTION

The subject matter of the present invention is a container for picking up organic material. The technical field of reference relates to the field of containers for picking up organic material, preferably material that is best kept at a distance from humans for health or hygiene reasons, or due to the hazardous nature of the chemical substances contained therein.

In particular, the technical field is preferably aimed at containers suitable for picking up the organic material when it is arranged on a (static) supporting surface using the container directly, without any further tool

BACKGROUND OF THE INVENTION

A particularly relevant example of this field is the bag for picking up animal excrement, which is commonly a simple bag, into which the human inserts one hand to hold the excrement, subsequently turning the bag inside out. However, for many people, this process is still somewhat unpleasant, as they come into close contact with the excrement and perceive, for example, its consistency and its heat.

So, bags of this type require close contact with the material. There are also other bags with systems to be able to close the opening of the bag by pulling on pull cords. However, these solutions are not suitable as the pull cord is soft and flexible and does not allow the material on the supporting surface to be picked up satisfactorily.

US2007/0296227 describes a bag comprising a container and a collar, engaged with an open-end portion of the bag. A rib is provided in the end portion and the collar is shaped to define a seat for the rib. The bag and the collar are assembled so that the rib is housed in the seat to fix the bag to the collar in a releasable manner.

EP2327837 describes a bag for solid waste comprising a mechanism for easy sealing of the bag.

BRIEF SUMMARY OF THE INVENTION

The object of the present invention is to provide a container and a related pick up method that overcome the aforementioned drawbacks of the prior art.

Said object is achieved in full by the container and by the method of the present invention, which is characterized by the contents of the claims set down below.

According to an aspect of the present description, the present invention provides a container for picking up material (preferably organic).

The container comprises a containment bag, configured to receive the organic material therein. The containment bag extends along a direction of extension between a first end and a second end.

The containment bag comprises a bottom, closed and arranged at the first end of the bag.

The containment bag comprises an opening arranged at the second end of the bag and defining an inlet section. The containment bag comprises a closing edge, delimiting the opening. The containment bag comprises a closing passage extending along the whole of the closing edge.

The container comprises a narrowing element. The narrowing element is inserted inside the closing passage. The narrowing element is configured to reduce, in response to a closing force applied by a user, the inlet section defined by the opening.

The narrowing element is an element having a bending stiffness around the direction of extension that is lower than the bending stiffness around an axis perpendicular to the direction of extension.

The narrowing element comprises a first gripping zone, arranged at a first end thereof. The narrowing element comprises a second gripping zone. The narrowing element is configured so that the opening reduces the inlet section pulling the first gripping zone in a first direction and the second gripping zone in a second direction, having at least a component opposite to the first direction.

These features allow the narrowing element to bend to reduce the inlet section but to remain rigid when it encounters the supporting surface on which the material is arranged. This makes it possible for the narrowing element to remain adhering to the supporting surface and, hence, to be able, during narrowing thereof, to go under the material and thereby ensure that the material is inserted in the containment bag. In other words, the narrowing element acts like a shovel and allows the waste to be picked up from the ground without the user coming into contact therewith.

Preferably, the first direction is directed toward the outside of the bag, so that the distance between the first end of the narrowing element and the closing passage increases as the narrowing element is pulled.

Preferably, the second direction is directed toward the outside of the bag, so that the distance between the second end of the narrowing element and the closing passage increases as the narrowing element is pulled.

In other embodiments, the second direction is directed toward the bag, so that the distance between the second end of the narrowing element and the closing passage remains substantially constant as the narrowing element is pulled.

This allows the material to be gripped (hence to be picked up) without coming into close contact therewith.

In an embodiment, the narrowing element comprises a first tie. The first tie comprises a first tab. The first tie comprises a first eyelet. The first tab and the first eyelet are arranged at opposite ends of the first tie.

In an embodiment, the narrowing element comprises a second tie. The second tie comprises a second tab. The second tie comprises a second eyelet. The second tab and the second eyelet are arranged at opposite ends of the second tie. Preferably, the first tie is inserted into the eyelet of the second tie. Moreover, the second tie is inserted into the eyelet of the first tie.

In this way, by pulling the first and the second tab the two eyelets move towards each other, narrowing the inlet section (however always maintaining the grip and keeping user's hands at a distance from the material).

In an embodiment, the closing passage comprises a first channel, having two respective access cavities. The first tie is housed in the first channel. The closing passage comprises a second channel, having two respective access cavities. The second tie is housed in the second channel.

In an embodiment, the first tie comprises a respective blocking mechanism, configured to allow an insertion of the second tab only in a narrowing direction. The narrowing direction is the direction corresponding to a narrowing of the inlet section. The second tie comprises a respective blocking mechanism, configured to allow an insertion of the first tab only in the narrowing direction.

This feature makes it possible to prevent, after having picked up the material, the two ties from being released and the inlet section from opening, allowing the material to be dropped. Moreover, in other embodiments, this solution makes it possible to verify opening of the container, which can only be opened by cutting the first and/or the second tie, thereby acting as verification of the integrity of the container.

Preferably, the narrowing element is made of hard plastic material and/or of metal material flexible with respect to a bend made around an axis parallel to the direction of extension.

In an embodiment, the narrowing element has a cross section comprising a first thickness, along a direction parallel to the direction of extension, and a second thickness, along a direction perpendicular to the direction of extension. The first thickness is greater than the second thickness.

In an embodiment, the first thickness is at least double the second thickness. In an embodiment, the first thickness is at least triple the second thickness.

This makes it possible to have greater rotation flexibility around the axis parallel to the direction of extension while it increases the bending stiffness along the direction perpendicular to the direction of extension.

In an embodiment, the container comprises a first gripping ring and/or a first gripping tab. The first gripping ring and/or the first gripping tab are arranged at the first gripping zone. In an embodiment, the container comprises a second gripping ring and/or a second gripping tab. The second gripping ring and/or the second gripping tab are arranged at the second gripping zone.

In an alternative embodiment, the narrowing element comprises the first tie, comprising the first tab and the eyelet. However, the first eyelet receives said first tab inside it.

In this embodiment, as during narrowing the hand would move toward the material (which pushes on the first eyelet), the narrowing element comprises a spacer element.

The spacer element is elongated between a first end, connected to the first eyelet (to transfer the thrust), and a second end, defining a thrust zone (on which the thrust of the user acts). The narrowing element is such that, by pulling the first tab in the first direction and pushing on the thrust zone of the spacer in the second direction, the inlet section is narrowed.

According to an aspect of the present description, the present invention provides a method for picking up organic material arranged on a supporting surface. The method comprises a step of arranging a container comprising:

- a containment bag, configured to receive the organic material therein and comprising a bottom, an opening, on the opposite end to the bottom and defining an inlet section, a closing edge, delimiting the opening, and a closing passage extending along the whole of the closing edge,
- a narrowing element, inserted inside the closing passage.

The method comprises a step of positioning the containment bag with the opening facing toward the supporting surface.

The method comprises a step of adhering the narrowing element to supporting surface, so that it surrounds the organic material.

The method comprises a step of applying a pulling force on the narrowing element, to reduce the inlet section.

The narrowing element, during application of the force, remains adhering to the supporting surface, being interposed between the organic material and the supporting surface.

According to an aspect of the present description, the present invention provides a method for producing a container for picking up material.

Said method comprises a step of providing a sheet of material (preferably plastic). The method provides for the production of a bag starting from a sheet of material that extends along a direction of extension and having a closing edge.

The method provides for folding of the closing edge toward the outside of the bag. The method provides for a step of connecting (heat sealing, quilting) the closing edge onto said bag, to create a closing passage.

In an embodiment, the method provides for making two cuts along the direction of extension in two mutually opposite points of the bag, to define two foldable flaps of the bag. The length of said cuts along the direction of extension defines the thickness of the closing passage.

The two flaps are folded toward the outside of the bag and connected (heat sealed, welded, quilted) to the bag, to define a first channel and a second channel of the closing passage.

The method provides for insertion of a narrowing element in the closing passage. In more detail, in an embodiment, the method provides a step of arranging the narrowing element with a first and a second tie, wherein the first tie comprises a first tab and a first eyelet and the second tie comprises a second tab and a second eyelet.

The method provides for insertion of the first tie into the first channel and of the second tie into the second channel, so that the first eyelet is on the same side as the second tab and the second eyelet is on the same side as the first tab.

The method provides a step of inserting the first tab into the second eyelet and the second tab into the first eyelet.

BRIEF DESCRIPTION OF THE SEVERAL VIEWS OF THE DRAWINGS

This and other features will be more apparent from the following description of a preferred embodiment, illustrated purely by way of non-limiting example in the accompanying drawings, wherein.

DETAILED DESCRIPTION OF THE INVENTION

Figure 1B:
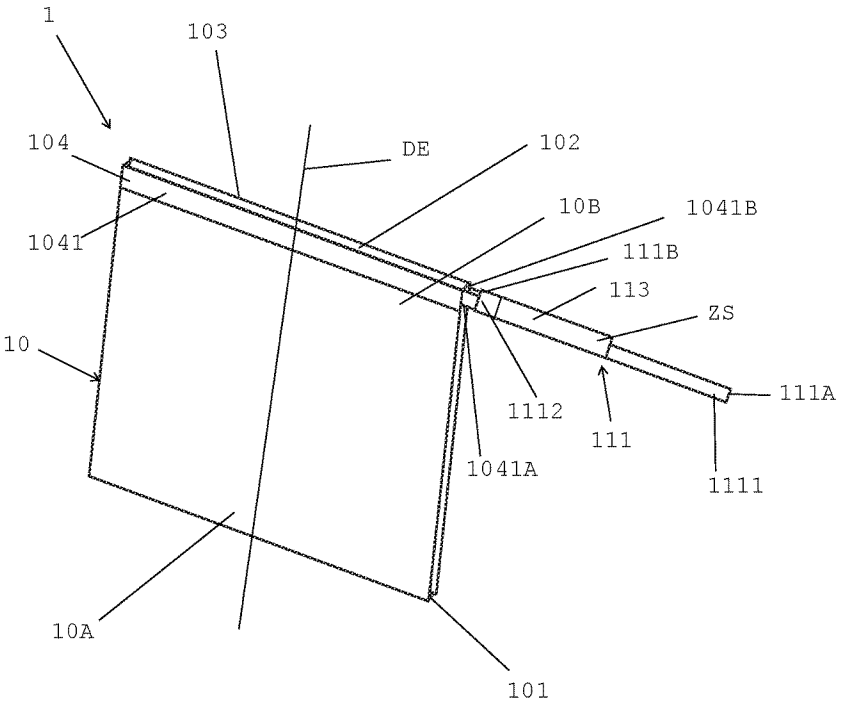
FIGS. 1A and 1B illustrate a first embodiment and a second embodiment of a container for picking up material according to the present invention, respectively.

With reference to the accompanying figures, the reference number 1 indicates a container for picking up material, preferably organic material.

The container 1 comprises a containment bag, configured to receive the organic material therein. The containment bag is made of fine plastic, hard plastic, cloth, fabric, cotton, biodegradable material and/or water-soluble material.

The containment bag 10 extends along a direction of extension DE between a first end 10A and a second end 10B.

The containment bag comprises a bottom 101, closed and arranged at the first end 10A of the containment bag. The containment bag comprises an opening 102, arranged at the second end 10B of the containment bag.

The opening 102 defines an inlet section SI, which is variable based on the use of the container 1.

The containment bag 10 is movable between an open configuration CA, in which the inlet section SI is the same as a first inlet section SI1, and a closed configuration CC, in which the material has already been picked up (collected) and wherein the inlet section SI is the same as a second inlet section SI2, smaller than the first inlet section SI1.

The containment bag 10 comprises a closing edge 103, delimiting the opening 102. Moreover, the containment bag 10 comprises a closing passage 14 extending (at least in part) along the closing edge 103.

The closing passage 104 is in substance a channel having a through section into which an elongated body such as a thread or a tie can be inserted.

The container 1 comprises a narrowing element 11, inserted inside the closing passage 104 and configured to reduce, in response to a closing force applied by a user, the opening 102 and, consequently, the inlet section SI defined by the opening 102.

The narrowing element 11 is an element having a bending stiffness around the direction of extension DE that is lower than the bending stiffness around an axis perpendicular to the direction of extension DE.

The narrowing element 11 is made of hard plastic material or of metal material flexible with respect to a bend made around an axis parallel to the direction of extension DE.

The narrowing element has a cross section comprising a first thickness, along a direction parallel to the direction of extension DE, and a second thickness, along a direction perpendicular to the direction of extension DE. The first thickness is greater than the second thickness. In an embodiment, the first thickness is at least double the second thickness. In an embodiment, the first thickness is at least triple the second thickness.

The narrowing element 11 comprises a first gripping zone 1111, arranged at a first end thereof, and a second gripping zone 1121, ZS. The narrowing element 11 is configured so that the opening 102 reduces the inlet section SI by pulling the first gripping zone 1111 in a first direction V1 and pulling or pushing the second gripping zone 1121, ZS in a second direction V2, having at least a component opposite to the first direction V1.

More precisely, the narrowing element 11 comprises a first tie 111 comprising the first gripping zone 1111. The first tie 111 extends along a respective first longitudinal axis L1 between a first end 111A and a second end 111B. The first gripping zone 1111 is a first tab 1111 arranged at the first end 111A of the first tie 111. The first tie 111 comprises a first eyelet 1112, arranged at the second end 111B of the first tie 111, opposite the first end 111A of the first tie.

Two embodiments of the narrowing element 11 are illustrated by way of example.

Figure 1A:
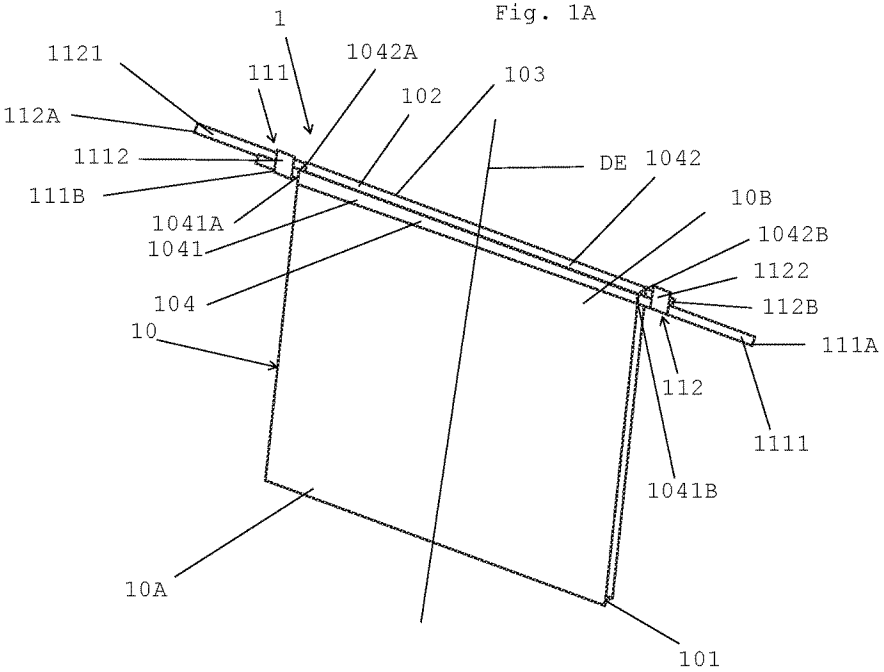
Figure 2B:
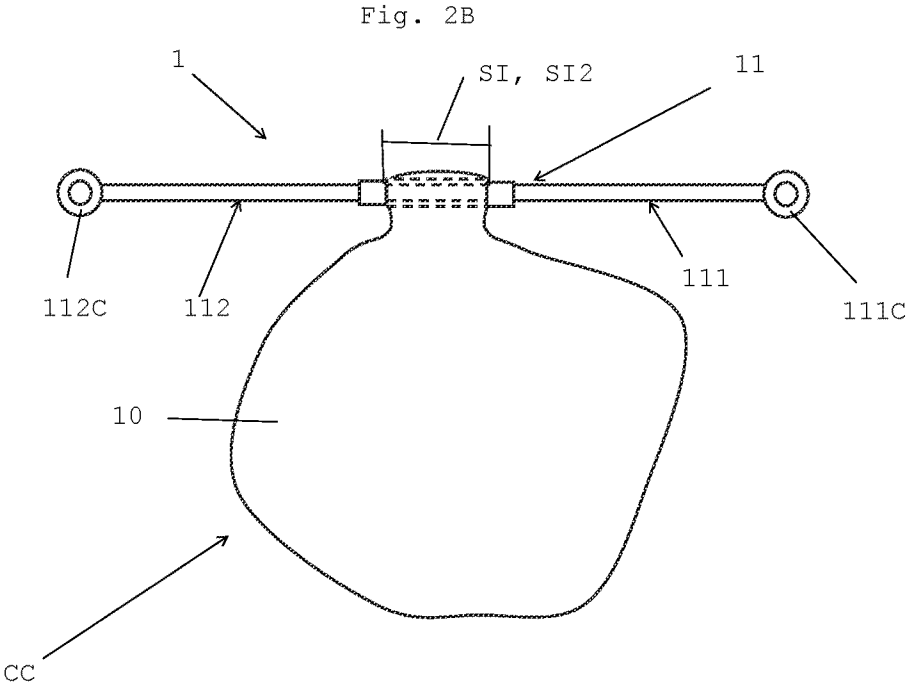
FIGS. 2A and 2B illustrate a first configuration and a second configuration of a container for picking up material according to FIG. 1A, respectively.
Figure 2A:
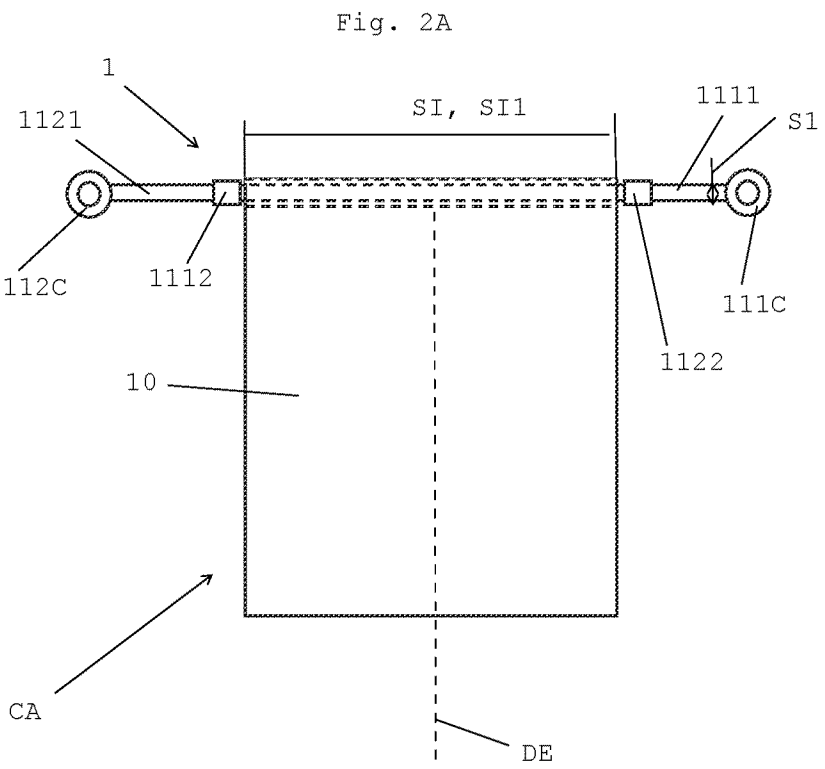

According to a first embodiment, illustrated in FIGS. 1A, 2A and 2B, the narrowing element 11 comprises a second tie 112, comprising the second gripping zone 1121. The second tie 112 extends along a respective second longitudinal axis L2 between a first end 112A and a second end 112B. The second gripping zone 1121 is a second tab 1121, arranged at the first end 112A of the second tie 112. The second tie 112 comprises a second eyelet 1122, arranged at the second end 112B of the second tie 112, opposite the first end 112A of the second tie.

In an embodiment, the container 1 comprises a first gripping ring 111C or a first gripping tab 111D, arranged at the first gripping zone, and a second gripping ring 112C or a second gripping tab, arranged at the second gripping zone.

In an embodiment, the first tie 111 (or the first tab 1111) is inserted into the second eyelet 1122 of the second tie 112. The second tie 112 (or the second tab 1121) is inserted into the first eyelet 1112 of the first tie 111.

This allows the first tab 1111 and the second tab 1121 to be pulled in a first direction V1 and in a second direction V2, opposite each other at least in part. This pulling force in opposite directions causes the first eyelet 1112 and the second eyelet 1122 to move toward each other, in turn causing a progressive narrowing of the closing edge 103 and, consequently, of the opening 102 and of the inlet section SI. However, the user's hands move away from the container, avoiding close contact with the material.

It must be observed that, in the presence of the two ties 111, 112, the closing passage 104 comprises a first channel 1041, with two respective access cavities 1041A, 1041B, i.e., a respective inlet cavity 1041A and a related outlet 041B, and a secondo channel 1042, with two respective access cavities 1042A, 1042B, i.e., a respective inlet 1042A and a related outlet 1042B. The first tie 111 is inserted inside the first channel 1041 and the second tie 112 is inserted into the second channel 1042.

The first tie 111 comprises a respective blocking mechanism, configured to allow an insertion of the second tab 112 into the first eyelet 1112 only in a direction opposite to the first direction V1. The second tie 112 comprises a respective blocking mechanism, configured to allow an insertion of the first tab 111 into the second eyelet 1122 only in a direction opposite to the second direction V2.

Figure 3B:
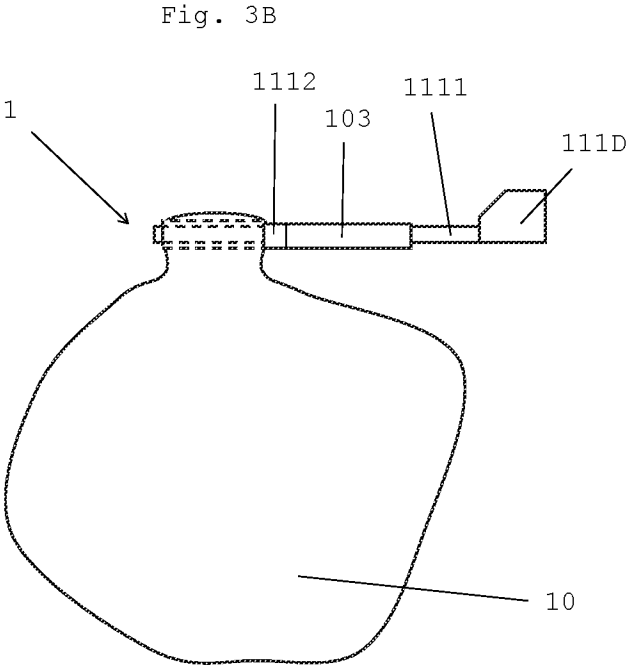
FIGS. 3A and 3B illustrate a first configuration and a second configuration of a container for picking up material according to FIG. 1B, respectively.
Figure 3A:
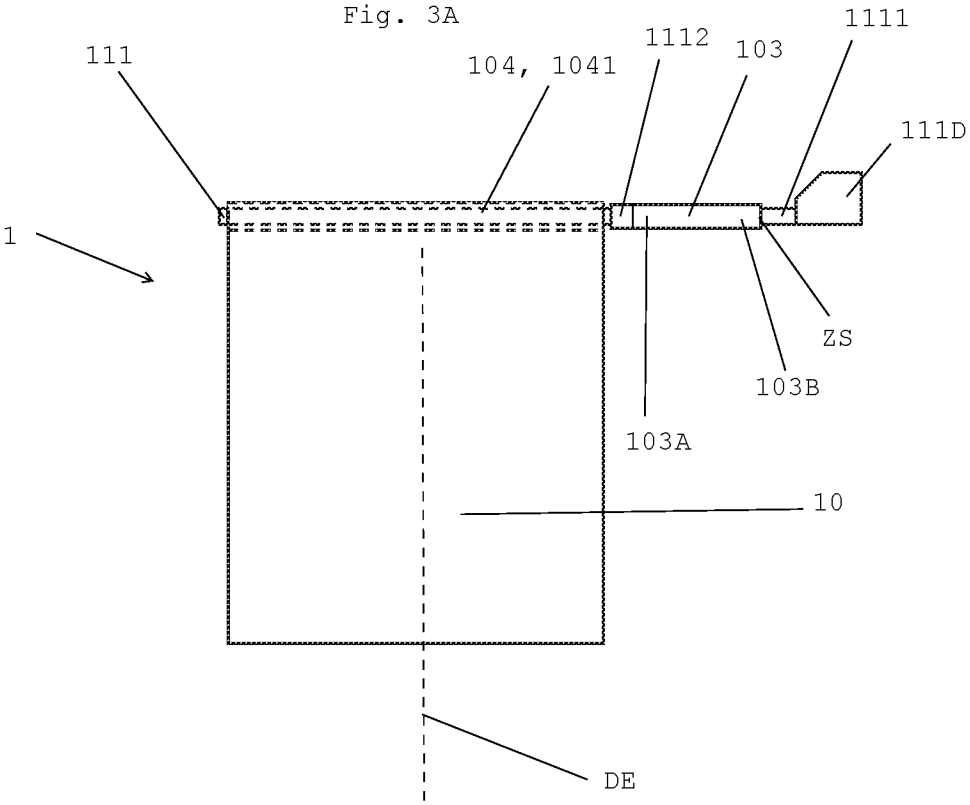

According to a further embodiment, illustrated in FIGS. 1B, 3A and 3B, the narrowing element 11 comprises only the first tie 111 comprising the first gripping zone 1111, i.e., the first tab 1111, and the first eyelet 1112, inside which the first tab 111 is inserted. In this case, the closing passage 104 comprises only one channel (the first channel 1041 with the related inlet 1041A and the related outlet 1041B) completely surrounding the closing edge 103, in substance side by side with the inlet 1041A and the outlet 1041B. Therefore, the first tie 111 is inserted inside the first (and only) channel 1041, so that the first tab 1111 is side by side with the first eyelet 1112.

In this embodiment, the first tab 1111 is inserted inside the first eyelet 1112, thereby creating, in all respects, a noose that, by pushing the eyelet toward the containment bag 10, allows a reduction of the inlet section SI.

However, as this would cause a progressive movement of the user's hand toward the material to be picked up, the narrowing element comprises a spacer 113.

The spacer 113 has the form of a hollow elongated body. The spacer extends along a direction of extension between a first end 113A, connected to the first eyelet 1112, and a second end 113B, defining the second gripping zone ZS. The first tab 1111 is inserted inside the spacer 113, after insertion of the first eyelet 1112. Therefore, the first end 113A of the spacer 113 contacts the first eyelet 1112 and pushes thereon while the second end 113B is facing the user. The second gripping zone ZS is a thrust zone ZS on which the user's hand can push, so that the thrust is transferred to the first eyelet 1112.

The narrowing element 11 is such that, by pulling the first tab 1111 in the first direction V1 and pushing on the thrust zone ZS of the spacer 113 in the second direction V2, the inlet section SI is narrowed.

In an embodiment, the spacer 103 can be produced in one piece with the first eyelet 1112 or, alternatively, it can be a separate component.

Figures 4A, 4B:
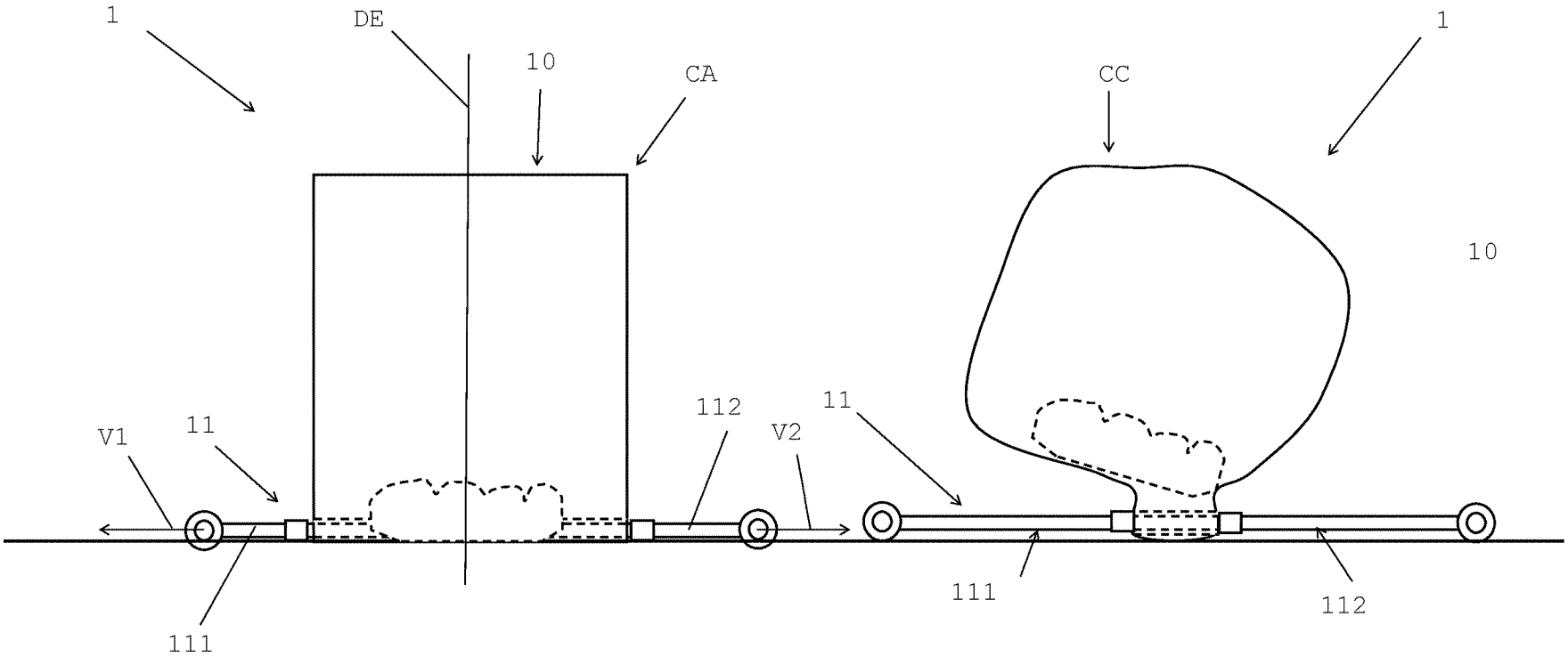
FIGS. 4A and 4B illustrate a first step and a second step of the method of picking up with the container of FIG. 1A in open configuration and in closed configuration, respectively.

The container is used according to a method for picking up a material that provides for arranging the container with the containment bag 10 in the open configuration CA. The container 10 is overturned, so that the opening 102 is facing the supporting surface of the material. The container 10 is moved toward the surface until the closing edge 104 and the narrowing element 11 are adhering to (in contact with) the supporting surface (FIG. 4A).

Subsequently, the first tab 111 and the second tab 112 are pulled in the first direction V1 and in the second direction V2, respectively (FIG. 4B), having at least a component opposite to the first direction V1.

When the containment bag 10 is in the closed configuration CC, i.e., the first tab 1111 and the second tab 1121 no longer move reciprocally, the method provides for overturning of the containment bag 10, with the bottom 101 facing the supporting surface so that the material falls to the bottom. Subsequently, by holding the bag by the first and the second tab 1111, 1121, the container can be disposed of without ever coming into contact with the outer surface of the containment bag 10.

I claim:

1. A container for picking up organic material, the container comprising:

a containment bag configured to receive the organic material therein, said containment bag having a direction of extension extending between a first end and a second end, said containment bag comprising:

a closed bottom at the first end of said containment bag;

an opening at the second end of said containment bag, said opening defining an inlet section;

a closing edge defining said opening; and a closing passage extending along said closing edge; and a narrowing element inserted inside said closing passage, said narrowing element configured to reduce the inlet section in response to a closing force applied by a user, wherein said narrowing element has a bending stiffness around the direction of extension that is less than a bending stiffness around an axis perpendicular to the direction of extension, wherein said narrowing element has a first gripping zone at a first end thereof and a second gripping zone, said narrowing element being configured such that said opening reduces the inlet section by pulling the first gripping zone in a first direction and pulling or pushing the second gripping zone in a second direction, the second direction having at least one component opposite to the first direction.

2. The container of claim 1, wherein said narrowing element has a first tie comprising the first gripping zone and a first eyelet arranged at opposite ends of the first tie, said narrowing element having a second tie comprising the second gripping zone and a second eyelet, arranged at opposite ends of the second tie, wherein the first gripping zone is a first tab, the second gripping zone being a second tab, the first tie being inserted in the second eyelet, the second tie being inserted into the first eyelet such that the first eyelet and the second eyelet move toward each other to narrow the inlet section by pulling the first tab and the second tab.

3. The container of claim 2, wherein said closing passage has a first channel having a pair of access cavities, the first tie being housed in the first channel, said closing passage having a second channel having another pair of access cavities, the second tie being housed in the second channel.

4. The container of claim 1, wherein said narrowing element is formed of a hard plastic material or of a metal material that is flexible relative to a bend around an axis parallel to the direction of extension.

5. The container of claim 1, wherein said narrowing element has a cross-section with a first thickness and a second thickness, a first thickness being along a direction parallel to the direction of extension, the second thickness being along a direction perpendicular to the direction of extension, wherein the first thickness is greater than the second thickness.

6. The container of claim 1, further comprising:

a first gripping ring at the first gripping zone; and a second gripping ring at the second gripping zone.

7. The container of claim 1, further comprising:

a first gripping tab at the first gripping zone; and a second gripping tab at the second gripping zone.

8. The container of claim 1, wherein said narrowing element has a first tie having a first gripping zone and a first eyelet, the first gripping zone being inserted inside the first eyelet, wherein said narrowing element has a spacer element that is elongated between a first end connected to the first eyelet and a second end defining a second gripping zone, the first gripping zone being a first tab, the second gripping zone being a thrust zone, wherein the inlet section is narrowed by pulling the first tab in the first direction and pushing on the thrust zone in the second direction.

* * * * *